United States Patent [19]

Vincent

[11] 4,226,488

[45] Oct. 7, 1980

[54] FURNITURE FRAME

[76] Inventor: Rod G. Vincent, 124 E. Putnam Ave., Greenwich, Conn. 06830

[21] Appl. No.: 26,057

[22] Filed: Apr. 2, 1979

[51] Int. Cl.[2] ..... A47B 43/00

[52] U.S. Cl. ..... 312/257 R; 312/108; 312/111; 312/214; 312/264

[58] Field of Search ..... 312/257 R, 263, 264, 312/214, 108, 111, 195, 261, 257 SK

[56] References Cited

U.S. PATENT DOCUMENTS

| | | | |
|---|---|---|---|
| 3,360,320 | 12/1967 | Lust | 312/257 R |
| 3,361,434 | 5/1968 | Alster | 312/257 R |
| 3,556,626 | 1/1971 | Schock | 312/214 |
| 3,754,805 | 8/1973 | Pangburn | 312/111 |
| 3,784,273 | 1/1974 | Nikolai | 312/257 R |
| 3,810,430 | 5/1974 | Siegal | 312/264 X |
| 3,851,938 | 12/1974 | McCowan et al. | 312/108 |
| 4,109,328 | 8/1978 | Mason | 312/111 X |
| 4,113,329 | 9/1978 | Thurman | 312/111 |

FOREIGN PATENT DOCUMENTS

| | | | |
|---|---|---|---|
| 2438525 | 2/1976 | Fed. Rep. of Germany | 312/257 R |
| 402315 | 11/1965 | Switzerland | 312/257 R |
| 581974 | 11/1976 | Switzerland | 312/257 SK |

*Primary Examiner*—James T. McCall

*Attorney, Agent, or Firm*—Kenyon & Kenyon

[57] ABSTRACT

The furniture frame is made of various pieces which can be slid together to form a completed piece of furniture. The pieces include components to define top, bottom and intermediate frames of wood, components to define drawer for sliding between the frames and divider frames to limit motion of the drawers and to interlock the assembled pieces.

17 Claims, 7 Drawing Figures

15
14
27
43
40
52
13
34
33
32
43
27
40
52
33
12
56
25
47
38
51
31
47
45
38
34
51
30
30
21
20
22
22
20
51
31
52
38
21
20
25
23
27
48
23
21
33
27
32
38
51
56

FURNITURE FRAME

This invention relates to a furniture frame. More particularly, this invention relates to a furniture frame made of collapsible construction.

Heretofore, various types of constructions have been known for making furniture, such as chests of drawers. In many cases, the constructions have been made of glued, doweled and/or nailed together pieces which form a rigid final assembly capable of being shipped from a manufacturing plant to a retail outlet and, subsequently, to a customer. However, because of the bulk of such furniture, transportation costs have usually been relatively expensive.

In some instances, in order to reduce the costs of transportation, attempts have been made to construct furniture frames of pieces which can be shipped in a flattened manner and assembled at a point of use. However, the constructions which have been previously used for this purpose have generally required some degree of proficiency for a customer to assemble the pieces into an esthetically pleasing piece of furniture. Further, in some cases, many of the parts of the furniture frame require preassembly at the manufacturing plant such that the overall bulk of an assembly is still of significant size with respect to the volume taken up during transportation.

In addition, in those cases where an owner may wish to move a piece of furniture such as a chest of drawers from one location to a distant location, the bulk of the furniture frame may present a problem, e.g. in securing the frame to an automobile.

Accordingly, it is an object of the invention to provide a furniture frame which is constructed of individual pieces which can be readily disassembled and assembled.

It is another object of the invention to provide a furniture frame of a construction which can be shipped in a minimum of space.

It is another object of the invention to provide a furniture frame which can be assembled in a relatively easy manner.

It is another object of the invention to provide a furniture frame of knock-down construction which can be assembled with a minimum of tools.

It is another object of the invention to provide a furniture frame of component pieces which are interchangeable.

Briefly, the invention provides a furniture frame which is constructed in a collapsible manner of a plurality of component pieces which can be readily assembled and disassembled with each other. To this end, the furniture frame is composed of a plurality of rectangular frames, a plurality of drawers and a plurality of divider frames which can be slid together into an integrated unit.

Each rectangular frame is formed with a pair of vertical sides each of which has a longitudinal slot in at least one of an upper surface and a lower surface.

The rectangular frames are arranged so as to constitute a base frame of which the furniture frame may rest, a top frame and a plurality of intermediate frames between which the drawers may slide. In this case, the bottom frame is provided with slots only in the upper surface to slidably receive a drawer. In similar manner, the top frame is provided with slots in only the lower surface so as to receive the upper end of a drawer. The intermediate frames are provided with slots in both the upper and lower surfaces to receive the respective drawer.

Each drawer is constructed to be slidably mounted between a pair of the adjacent frames. To this end, each drawer has a pair of vertical sides of hollow construction, each of which carries an elongated rail at top and bottom which is slidably received in a respective groove of an adjacent rectangular frame. Also, each rail is formed with a longitudinal groove which extends from a front end towards a rear end to an intermediate point short of the rear end.

In addition, each drawer includes a front panel which is removably secured by suitable means to the vertical sides in perpendicular relation. A back panel is also slidably mounted on the vertical sides in perpendicular relation while a bottom panel is slidably disposed in the vertical sides and back panel. The means for securing the front panel to the drawer sides may include a pair of blocks which are fixed to the front panel on opposite sides to extend into the hollow cavities formed by the vertical sides as well as a plurality of screws which pass through the blocks and are threaded into a wall of each vertical side.

Each divider frame is vertically disposed and is slidably received in a pair of adjacent rectangular frames to hold the frames in an upright manner. Each divider frame is constructed of a U-shaped manner and a vertical bar to define a rectangular shape. The U-shaped member forms a vertical leg which extends through a vertical side of a drawer as well as through the grooves in the rails of the drawer while two horizontal legs of the member are slidably mounted in the respective adjacent frames. The vertical bar of each divider frame is fitted into the ends of the two horizontal legs behind the rear of a drawer to retain the divider frame in place. The position of the divider frames are such that a drawer can be slid out of a completed furniture frame to a point whereat the ends of the grooves in the rails of the drawer abut against the vertical legs of the divider frames.

The furniture frame components may be made of any suitable materials. For example, the various rectangular frames may be made of wood while the drawers, except for the front panel, are made of plastic. In this case, the front panel is made of wood so as to match the exposed surfaces of the various rectangular frames. The bottom panel of the drawer may be made of a material such as masonite while the divider frames can be made of a suitable metal such as steel.

The furniture frame may also be provided with a removable top panel which can be mounted on and across the top frame to provide a smooth surface. The top panel also has a depending skirt at the front end which is disposed over the top frame to provide a smooth appearance to the assembled furniture frame.

These and other objects and advantages of the invention will become more apparent from the following detailed description taken in conjunction with the accompanying drawings wherein:

FIG. 5 illustrates a view similar to FIG. 4 of a drawer in a fully opened position in accordance with the invention;

Figures 1, 2:
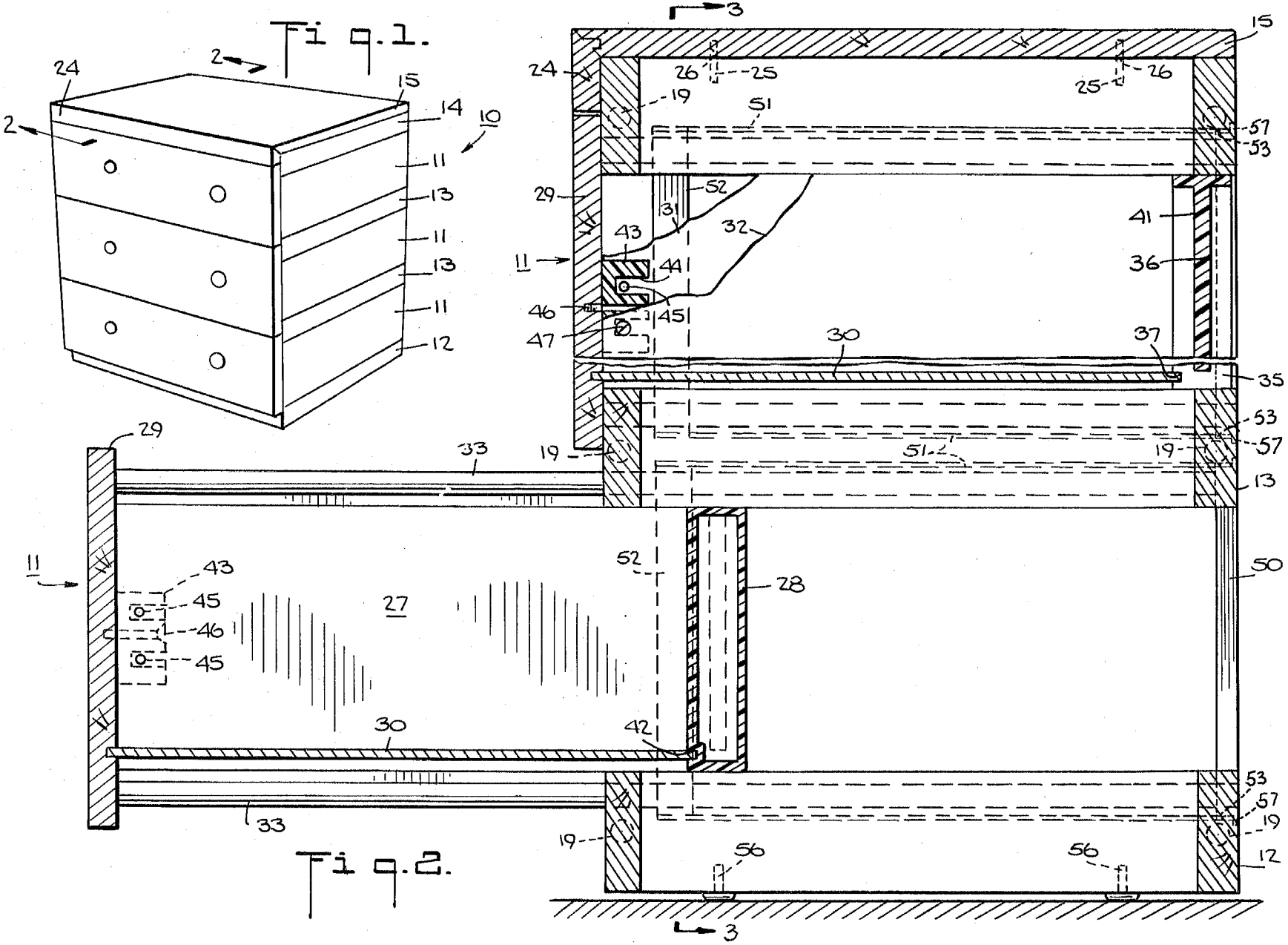
FIG. 1 illustrates a perspective view of a collapsible furniture frame according to the invention.
FIG. 2 illustrates a view taken on line II—II of FIG. 1.

Referring to FIG. 1, the furniture frame 10 is constructed as a chest of drawers 11 in the form of a generally cubic shape. The furniture frame 10 includes a base frame 12, a plurality of intermediate frames 13, a top frame 14 and a top panel 15. The various frames 12, 13, 14 are each of rectangular shape while the top panel 15 forms a flat surface.

Figure 6:
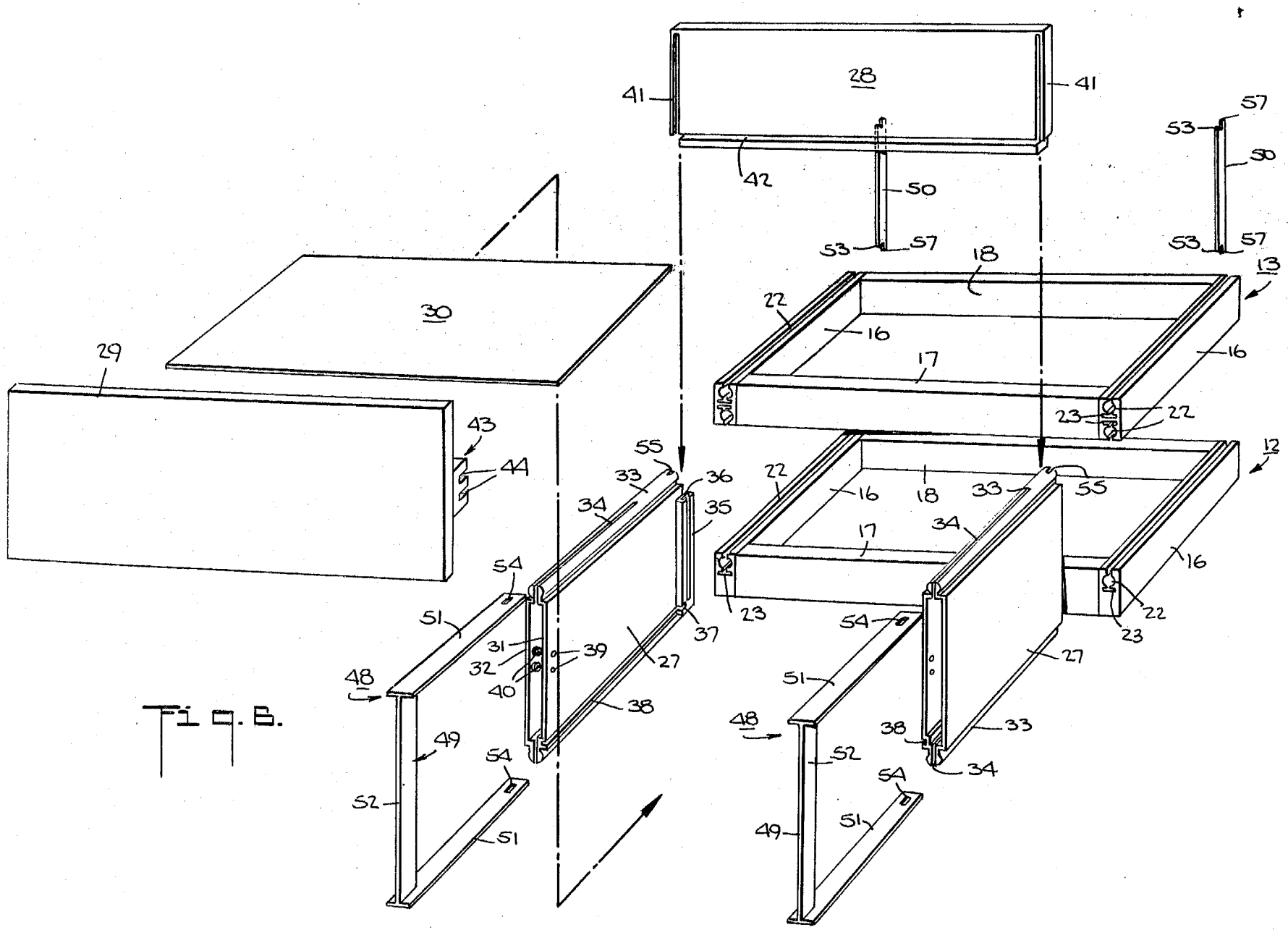
FIG. 6 illustrates an exploded view of a drawer and two adjacent frames of a furniture frame constructed in accordance with the invention.

Referring to FIG. 6, the bottom frame 12 is formed of a pair of parallel side rails 16, a front rail 17 and a back rail 18. The front and back rails 17, 18 are secured to the side rails 16 by means of dowels 19 (see FIG. 2). In addition, each side rail 16 is of two piece construction (see FIG. 3) wherein two longitudinal pieces are sandwiched together via a pin 20 and recess 21 arrangement (see FIG. 3). As shown each end rail 16 has a key-hole shaped slot 22 which extends along the entire length of the upper surface of the rail 16. In addition, a T-shaped slot 23 is disposed below the key-hole shaped slot 22 and also extends throughout the length of the rail 16 in communication with the key-hole shaped slot 22.

Each intermediate frame 13 is constructed in like manner to the bottom frame 12 and like reference numerals indicate like parts as described above. In addition, each side rail 16 of the intermediate frames 13 is provided with a key-hole shaped slot 22 and a T-shaped slot 23 in both the upper and lower surfaces.

Figure 3:
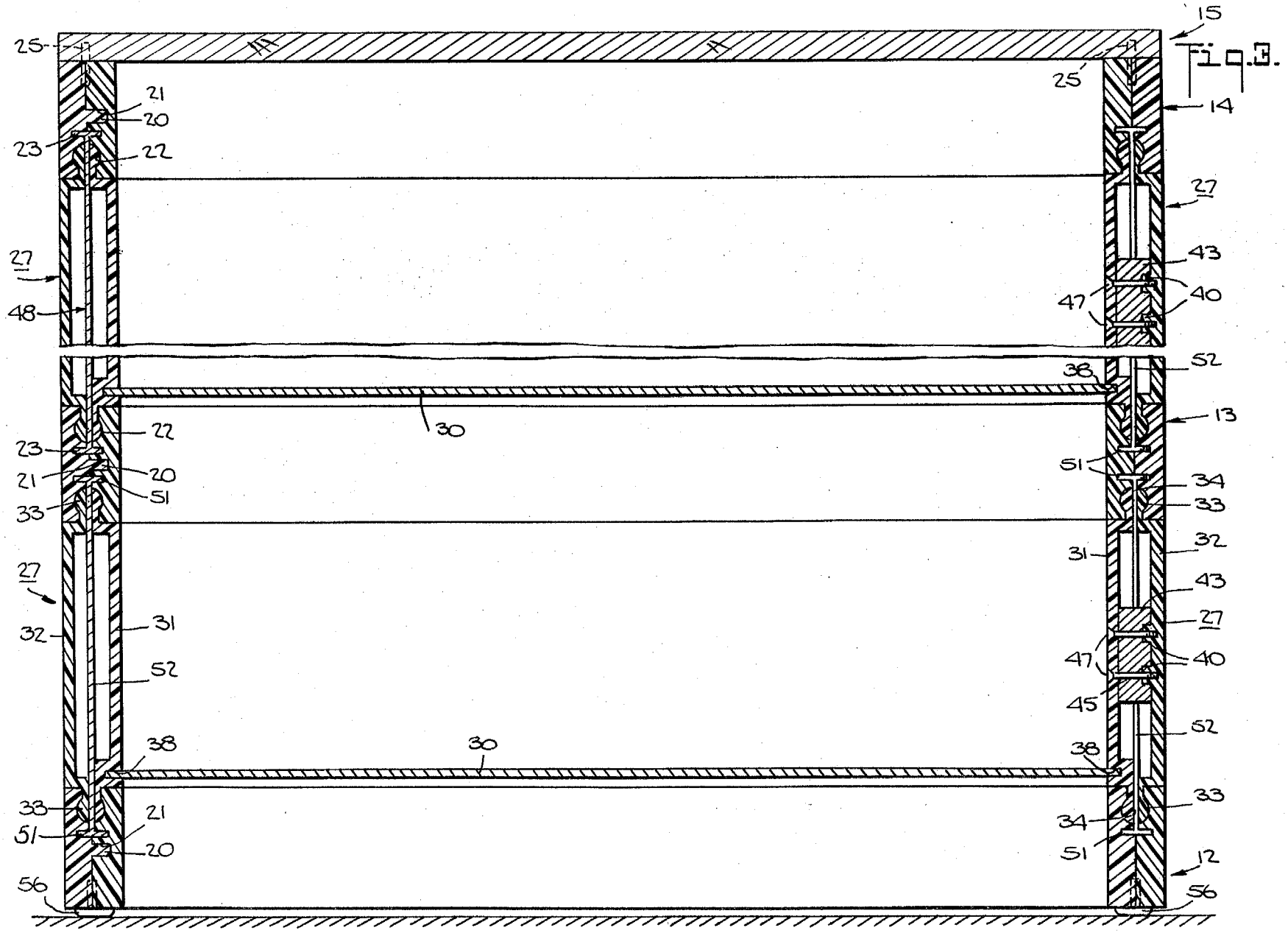
FIG. 3 illustrates a view taken on line III—III of FIG. 1.
Figure 3:
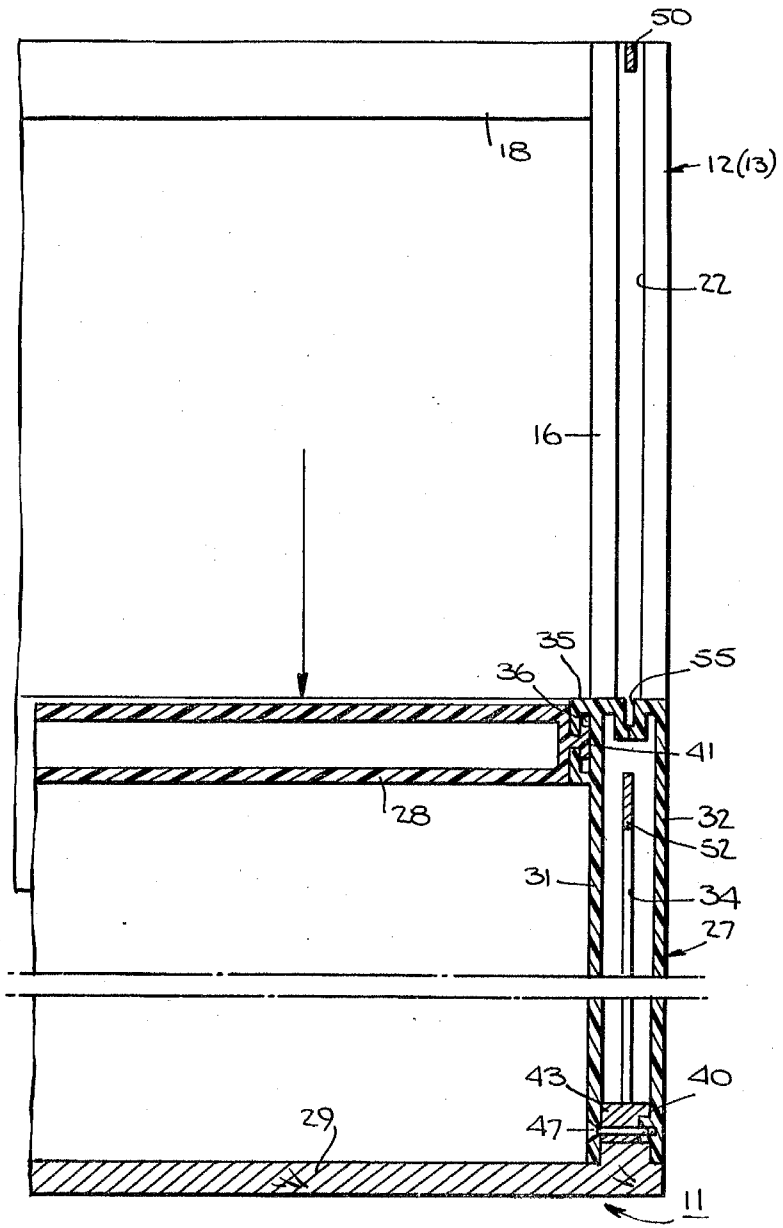

Referring to FIG. 3, the top frame 14 is constructed in the same manner as the bottom frame 12 but is oriented in reverse manner, i.e. upside down.

Referring to FIG. 2, the top panel 15 is formed of a flat rectangular board with a depending skirt 24 along the front edge. The top panel 15 is held in place on the top frame 14 via pins 25 which are disposed in suitable locations in the side rails 16 of the top frame 14 and received in bores 26 of the top panel 15. This arrangement may be reversed such that the pins 25 are fixed in the top panel 15 and received in bores of the top frame 14.

Figure 7:
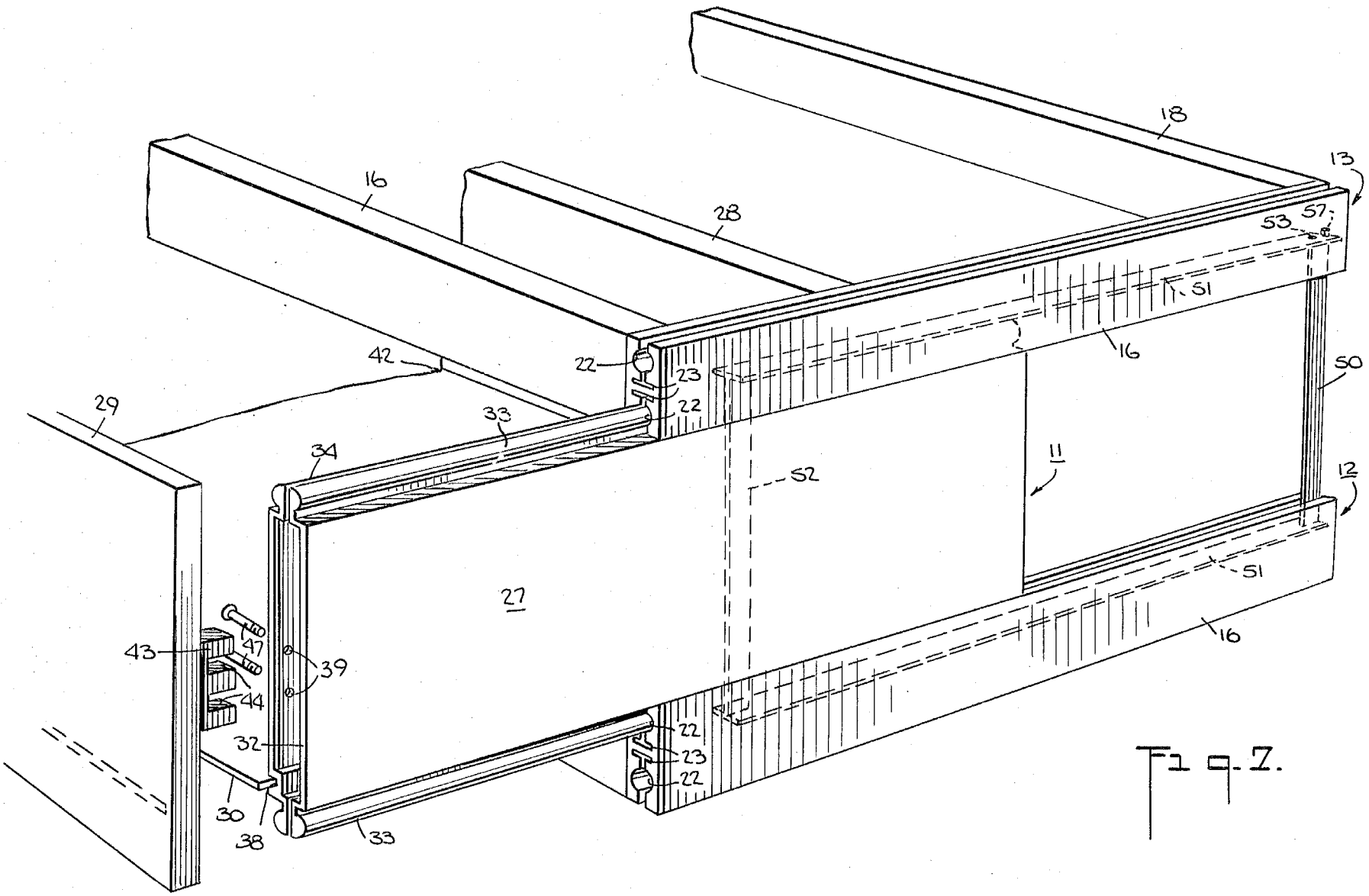
FIG. 7 illustrates a partially exploded view of a drawer mounted between two frames of a furniture frame constructed in accordance with the invention.

Referring to FIGS. 6 and 7, each drawer 11 has a pair of hollow vertical sides 27, a hollow back panel 28, a front panel 29 and a bottom panel 30. Each hollow vertical side 27 has a pair of walls 31, 32 which are spaced apart to define a hollow cavity. In addition, each vertical side 27 has a pair of elongated rails 33 each of which is slidably received in a key-hole shaped slot 22 and is of similar shape. As indicated, the rails 33 extend upwardly from the upper and lower ledges of the vertical sides 27. Each rail 33 is also provided with a longitudinal groove 34 which extends from the front end towards the rear end to an intermediate point, terminating at a small distance from the rear end. Each groove 34 communicates directly with the cavity defined between the walls 31, 32.

Each vertical side 27 of a drawer 11 also carries a vertical guideway 35 at the rear end which is formed with a vertically disposed T-shaped slot 36 and a horizontally disposed notch 37 at the lower end. Each vertical side 27 also has a horizontally disposed recess 38 extending along the inside wall 31 in the same plane as the notch 37 in the guideway 35. The recess 38 and notch 37 of each vertical side 27 are sized to slidably receive the bottom panel 30.

Each inside wall 31 is provided with a pair of apertures 39 while the opposite outer wall 32 is provided with a pair of hollow studs 40 on the inside which are aligned with the apertures 39 for purposes as described below.

The hollow back panel 28 is provided with a pair of T-shaped sliders 41 which are vertically disposed at each vertical edge. These sliders 41 are sized to mate with and slide in the slots 36 of the guideways 35 on the vertical sides 27. In addition, the back panel 28 has a horizontally disposed recess 42 near the lower edge which is disposed in alignment with the notch 37 of the guideways and the recess 38 of the vertical walls 27 to receive the bottom panel 30.

Each vertical side 27 is made of plastic with the individual walls 31, 32 being separably made and subsequently secured together by gluing or the like. The two walls 31, 32 are substantially mirror images of each other except for the provision of the guideways 35, recess 38, holes 39 and studs 40. In addition, each wall 31, 32 can be provided with stiffening ribs (not shown) in order to stiffen the completed vertical sides 27.

The back panel 28 is also made of two piece construction. In this regard, the rearmost piece is provided of generally boxedshape construction with the sliders 41 formed thereon while the front piece is formed as a substantially flat panel which can be glued to the back piece. Also, the rearmost piece is also provided with vertical ribbing (not shown) to stiffen the panel 28 while the front piece contains the recess 42.

Since the sides 27 and back panel 28 are made of plastic, the various guideways 35 and sliders 41 can be integrally molded in these components.

The front panel 29 of a drawer 11 is of flat rectangular construction and is made of wood or any other suitable material to compliment the appearance of the chest 10. In addition, means are provided for removably securing the front panel 29 to the vertical sides 27. As shown in FIG. 7, this securing means is in the form of a pair of blocks 43 each of which is provided at an opposite end of the panel 29. Each block 43 is provided with a pair of recesses 44 in one side as well as with a pair of apertures 45 (see FIG. 2) and is secured to the panel 29, for example by a threaded screw 46 (FIG. 2). In addition, the securing means includes a pair of screws 47 which pass through the apertures 39 in the inner wall 31 of a vertical side 27, the apertures 45 in a block 43 and into the studs 40 of an outer wall 32. Tightening of the screws 47 creates a clamping action of the walls 31, 32 on the block 43 to further enhance the securement of the panel 29 to the vertical sides 27. The recesses 44 in each block 43 are sized to accommodate the studs 40.

Referring to FIGS. 6 and 7, the furniture frame also has a plurality of divider frames 48 made of any suitable material, for example steel, to hold the various frames 12, 13, 14 and drawers 11 together in the assembled condition. Each frame 48 is formed of a U-shaped member 49 and a vertical bar 50. The U-shaped member 49 has a pair of horizontally disposed legs 51 of flat shape slidably received in the slots 23 of a frame 12, 13, 14 and a vertical leg 52 which interconnects the legs 51. This vertical leg 52 is sized to slide through the slots 22, 23 of a frame 12, 13, 14 as well as through the grooves 34 in the rails 33 of the vertical sides 27 of a drawer 11. The vertical bar 50 is provided with a tongue 53 at each end to be fitted into a suitable aperture 54 at the rear of each horizontal leg 51 of the U-shaped member 49. Each bar 50 is disposed at the rear of the chest 10 behind a drawer 11. To this end, each rail 33 of a vertical drawer side 27 has a notch 55 which is sized to receive a vertical bar 50 in flush relation when the drawers 11 are closed within the chest 10.

Referring to FIG. 2, the chest 10 is also provided with a leveling means in the form of a plurality of leveling screws 56 which are threaded into the bottom frame 12 for leveling purposes.

In order to assemble the chest 10, the U-shaped members 49 of a pair of divider frames 48 are first inserted from the front into the slots 22 of the bottom frame 12 and an intermediate frame 13.

Next, a pair of vertical sides 27 are slid into the slots 22 from the rear of the frames 12, 13. The vertical bar 50 for each divider frame 48 is then snapped into and between the horizontal legs 51 of each U-shaped member 49 to retain the vertical sides 27 in place.

Thereafter, a hollow back panel 29 is slid into place in the guideways 35 of the vertical sides 27 via the T-shaped sliders 41. Next, a bottom panel 30 is slid into the recesses 38, 42 of the sides 27 and back panel 28.

A front panel 29 which has the blocks 43 secured in place is then positioned with the blocks 43 extending into the cavities of the vertical sides 27. Pairs of screws 47 are then passed through the openings 39 in the inner wall 31 through the apertures 45 in the blocks 43 and threaded into the studs 40 in the outer walls 32 until the blocks 43 are clamped between the walls 31, 32. The drawer 11 is then in a fully assembled condition and is slidably mounted between the base frame 12 and the intermediate frame 13. Similar steps are taken to build up the remainder of the drawers 11 and frames 13, 14 of the cabinet 10. After the last drawer 11 has been put in place, the top panel 15 is fitted down onto the top frame 14 via the pins 25.

The leveling screws 56 are also threaded into the bottom surfaces of the end rails of the bottom frame 12 and adjusted to level the cabinet 10 for use.

In order to knock down the cabinet 10, a reverse sequence of steps can be performed.

It is to be noted that the assembly of the drawer can be slightly modified, for example by fixing the back panel 28 to the sides 27 before sliding the sides 27 into the frames 12, 13.

Figure 4:
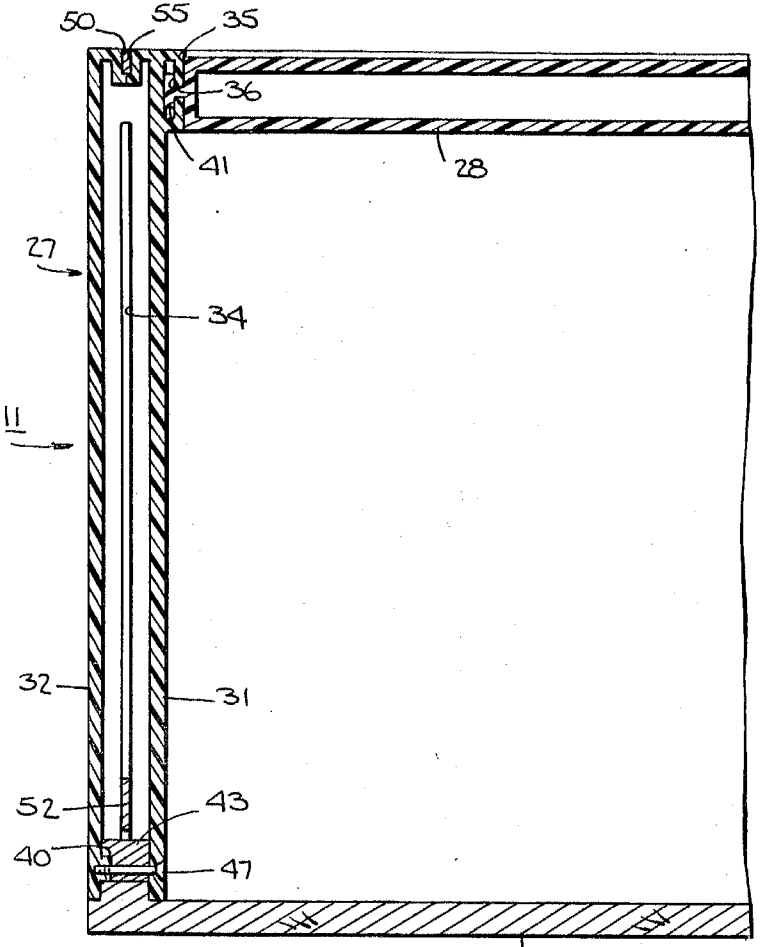
FIG. 4 illustrates a partial top view of a drawer of the furniture frame in closed position.

When in use, a drawer may be moved from a closed position (FIG. 4) to a fully opened position (FIG. 5). In the fully opened position (FIGS. 2 and 5), the vertical legs 52 of the divider frame 48 abut against the end of the grooves 34 in the sides 27 to prevent further outward movement of the drawer 11. In this regard, the divider frames 48 are fixed within the frames 12, 13, 14 by virtue of the fact that the vertical bars 50 have projections 57 (FIG. 2) at the upper and lower ends which project above and below the T-shaped slots 23 of the respective frames 12, 13, 14 within the notches 55 to create a stop should a drawer 11 be pulled forward.

It is to be noted that the furniture frame can be constructed with one or a multiplicity of drawers.

The invention thus provides a furniture frame which is made of a collapsible construction which can be readily taken apart and reassembled. The various components of the furniture frame can be made in relatively simple manner. For example, the plastic sides and back panel of the drawer can be molded from suitable plastic materials and glued together into unitary components. Also, the individual pieces of the various frames 12, 13, 14 can be readily machined of wood and glued or doweled together as the case may be. Similarly, the means by which the front panel of each drawer is secured to the sides can be easily made.

In order to transport the components of the furniture frame, the various components can be laid in a flat manner with the various flattened pieces stacked one on top of the other to conserve space.

What is claimed is:

1. A furniture frame comprising a base frame;

a top frame;

a drawer slidably mounted between said base frame and said top frame, said drawer including a pair of vertical sides, each said side being hollow and having a longitudinal groove extending from a front end towards a rear end to an intermediate point at each of an upper edge and a lower edge; and a pair of divider frames, each said divider frame including a U-shaped member having a pair of horizontal legs each slidably mounted in a respective one of said base frame and said top frame and a vertical leg extending through a respective one of said sides in slidable relation to said grooves of said respective side and a vertical bar removably secured in said horizontal legs to the rear of said respective side.

2. A furniture frame as set forth in claim 1 wherein each said vertical side has a pair of elongated rails, and each of said base frame and said top frame includes an elongated slot slidably receiving a respective rail of a respective vertical side.

3. A furniture frame as set forth in claim 2 wherein each vertical side is hollow.

4. A furniture frame as set forth in claim 1 wherein said drawer includes a front panel removably secured to said vertical sides in perpendicular relation and a back panel slidably mounted on said vertical sides in perpendicular relation.

5. A furniture frame as set forth in claim 4 wherein said drawer further includes a bottom panel slidably disposed in said vertical sides and said back panel.

6. A furniture frame comprising a bottom frame of rectangular shape said frame having a pair of parallel side rails, each rail having a longitudinal slot disposed in an upper surface;

a top frame of rectangular shape, said top frame having a pair of parallel side rails, each said rail having a longitudinal slot disposed in a lower surface, a plurality of intermediate frames of rectangular shape disposed between said bottom and top frames, each said intermediate frame having a pair of parallel side rails, each said rail having a pair of longitudinal slots, each said slot being disposed in a respective one of an upper surface and a lower surface of said respective rail;

a plurality of drawers, each said drawer being slidably mounted between each pair of adjacent frames, each said drawer having a pair of vertical sides, each said side having a pair of elongated rails, each said elongated rail being slidably received in a respective slot of an adjacent frame; and a plurality of divider frames each said divider frame including a U-shaped member having a pair of horizontal legs slidably received in a respective side rail of a respective adjacent frame and a vertical leg extending through a respective vertical side of a drawer, said divider frame having a vertical bar removably secured in said horizontal legs to the rear of a respective drawer.

7. A furniture frame as set forth in claim 6 wherein each vertical side is hollow.

8. A furniture frame as set forth in claim 7 wherein each rail of a respective drawer has a longitudinal groove extending from a front end towards a rear end to an intermediate point and receiving a respective vertical leg of a divider frame therein.

9. A furniture frame as set forth in claim 7 wherein each vertical side has a plurality of internally disposed stiffening ribs.

10. A furniture frame as set forth in claim 6 wherein each drawer includes a front panel and means removably securing said front panel to said vertical sides of said drawer.

11. A furniture frame as set forth in claim 10 wherein each vertical side is hollow and said means includes a pair of blocks fixed to said front panel, each said block extending into a respective hollow vertical side, and screws threaded into opposite walls of each vertical side, and passing through a respective block to secure a respective block between said walls.

12. A furniture frame as set forth in claim 6 wherein said vertical sides are made of plastic.

13. A furniture frame as set forth in claim 12 wherein said divider frames are made of metal.

14. A furniture frame as set forth in claim 6 which further comprises a top panel removably mounted on and across said top frame, said top panel having a depending skirt at a front end disposed over said top frame.

15. A furniture frame as set forth in claim 6 which further comprises a plurality of leveling screws threaded into an underside of said bottom frame.

16. A furniture frame as set forth in claim 6 wherein each slot of a respective frame has a key-hole shape and each elongated rail of a drawer is of inverse mating key-hole shape and wherein each side rail of a frame has a flat horizontal slot adjacent said key-hole shaped slot receiving a horizontal leg of a divider frame.

17. A collapsible furniture frame comprising a plurality of rectangular framges, each of said frames having a pair of vertical sides, each said vertical side having a longitudinal slot in at least one of an upper surface and a lower surface thereof;

at least one drawer slidably mounted between a pair of adjacent frames and having a pair of hollow vertical sides, each said side having a pair of elongated rails with each said rail slidably received in a respective slot of an adjacent frame and having a longitudinal groove; and a plurality of vertically disposed divider frames, each said frame being slidably received in a pair of adjacent frames and having a vertical leg extending through a respective vertical side of a drawer and said grooves thereof.

* * * * *

UNITED STATES PATENT AND TRADEMARK OFFICE

CERTIFICATE OF CORRECTION

PATENT NO. : 4,226,488

DATED : October 7, 1980

INVENTOR(S) : Rod G. Vincent

It is certified that error appears in the above—identified patent and that said Letters Patent is hereby corrected as shown below:

Column 1, line 62, after first occurrence of "frame", delete "of" and insert --on--.

Column 2, line 28, after "U-shaped", change "manner" to --member--.

Signed and Sealed this

Third Day of March 1981

[SEAL]

*Attest:*

RENE D. TEGTMEYER

*Attesting Officer*

*Acting Commissioner of Patents and Trademarks*